US008317186B2

(12) United States Patent
Lai

(10) Patent No.: US 8,317,186 B2
(45) Date of Patent: Nov. 27, 2012

(54) PAPER DELIVERING DEVICE

(75) Inventor: Kuo-Ming Lai, New Taipei (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/268,169

(22) Filed: Oct. 7, 2011

(65) Prior Publication Data

US 2012/0261878 A1 Oct. 18, 2012

(30) Foreign Application Priority Data

Apr. 18, 2011 (TW) ..... 100113313

(51) Int. Cl.
*B65H 7/08* (2006.01)

(52) U.S. Cl. ..... 271/110; 271/111; 271/145

(58) Field of Classification Search ..... 271/110, 271/111, 145; 399/371
See application file for complete search history.

(56) References Cited

U.S. PATENT DOCUMENTS

| | | | | |
|---|---|---|---|---|
| 6,206,359 | B1 * | 3/2001 | Hirota et al. | 271/3.15 |
| 7,197,273 | B2 * | 3/2007 | Imai et al. | 399/371 |
| 7,460,825 | B2 * | 12/2008 | Sawanaka et al. | 399/371 |
| 7,665,731 | B2 * | 2/2010 | Shingai | 271/265.02 |
| 7,692,829 | B2 * | 4/2010 | Huang et al. | 358/498 |
| 2005/0042005 | A1 * | 2/2005 | Imai et al. | 399/371 |

* cited by examiner

*Primary Examiner* — David H Bollinger
(74) *Attorney, Agent, or Firm* — Altis Law Group, Inc.

(57) ABSTRACT

A paper delivering device includes a delivering module and a detecting module. The delivering module includes a paper tray for supporting at least one paper, at least one roller attached on the paper tray for delivering the at least one paper, and a blocking member pivotably attached to the paper tray. The detecting module detects whether the at least one paper is placed in a position predetermined as correct. The blocking member is locked at a first position to prevent the sliding movement of the at least one paper when the at least one paper is not placed at the predetermined position, or may be rotated to a second position to allow the forward movement of the at least one paper when the at least one paper is correctly placed.

20 Claims, 7 Drawing Sheets

PAPER DELIVERING DEVICE

BACKGROUND

1. Technical Field

The present disclosure relates to a paper delivering device capable of detecting whether papers are placed at correct positions.

2. Description of Related Art

Paper delivering devices are used in printing machines, scanning machines, fax machines, or the like. The paper delivering devices include a paper tray on which one or more papers are placed. When the paper delivering device is started, the paper delivering device deliver the papers on the paper tray to a paper outlet one by one. However, if the papers are placed on the paper tray at an incorrect position where the papers are oriented obliquely relative to a paper inlet of the paper delivering devices, the paper delivering device sometimes can not manage the paper successfully.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation. In the figures of the accompanying drawings, like references indicate similar elements. It should be noted that references to "an" or "one" embodiment in this disclosure are not necessarily to the same embodiment, and such references mean at least one.

Figure 1:
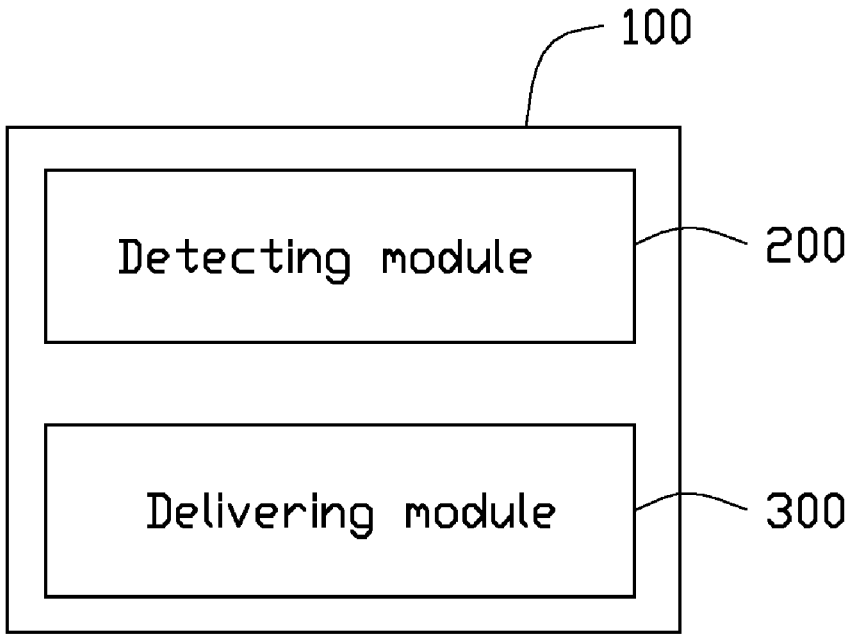
FIG. 1 is a block diagram of an embodiment of a paper delivering device.

Referring to FIG. 1, an embodiment of a paper delivering device 100 includes a detecting module 200 and a delivering module 300. The detecting module 200 detects whether a paper has been correctly placed in the delivering module 300. The delivering module 300 delivers the paper if the paper has been correctly placed.

Figure 2:
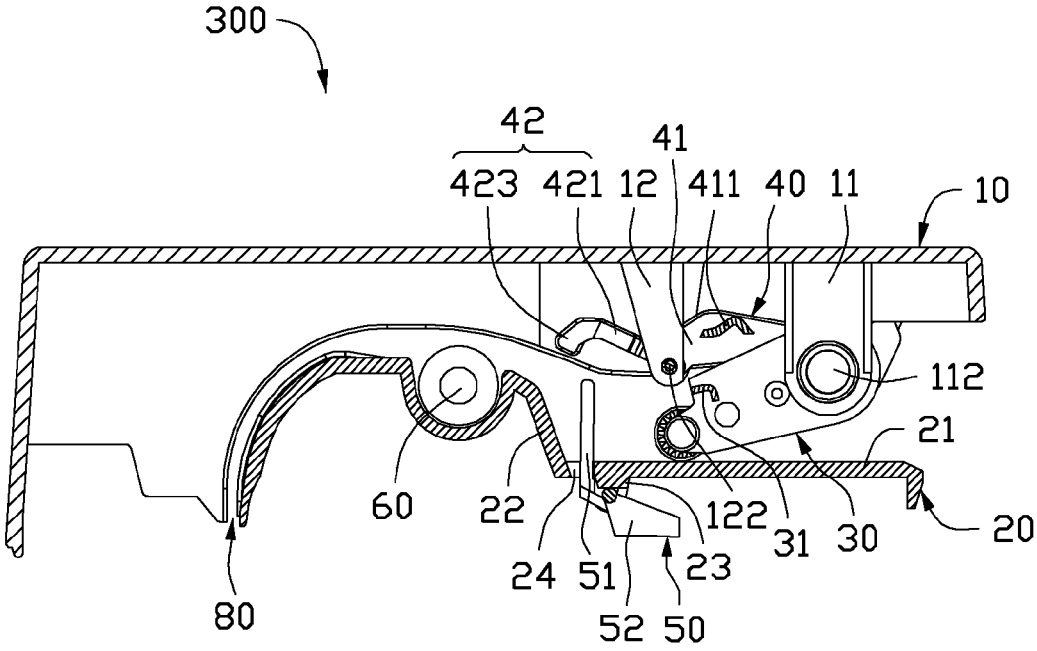
FIG. 2 is a cross sectional view illustrating the delivering module of the paper delivering device of FIG. 1, showing the delivering module in an original state.

Referring to FIG. 2, the delivering module 300 includes a cover 10, a paper tray 20, a first pivotable member 30, a second pivotable member 40, and a blocking member 50. A first mounting piece 11 and a second mounting piece 12 extend downwards from the inner surface of the cover 10. A first end of the first pivotable member 30 is pivotably attached to the first mounting piece 11 by a first pivot 112. A first resisting piece 31 protrudes from a side wall of the first pivotable member 30. The first resisting piece 31 is located adjacent to the second end of the first pivotable member 30 and has an L-shape. The second end of the first pivotable member 30 has an arc shape and abuts the paper tray 20 when the first pivotable member 30 is at the original slanted position. The second pivotable member 40 includes a first portion 41 and a second portion 42 connecting to the first portion 41. The first portion 41 is wider than the second portion 42. A second pivot 122, at the junction between the first portion 41 and the second portion 42, is attached to the second mounting piece 12. A second resisting piece 411 protrudes from the first portion 41 and corresponds to the first resisting piece 31. The second resisting piece 411 is substantially "L" shaped. The second portion 42 comprises an arm 421 extending from the first portion 41 and a hook 423 bent down approximately ninety degrees from the distal end of the arm 421. When the second pivotable member 40 is in an original position, the arm 421 is oriented obliquely upwards and the hook 423 is oriented obliquely downwards. The paper tray 20 includes a horizontal supporting portion 21 and a portion (tortuous portion 22) which substantially follows the shape(s) shown in cross section in FIG. 2, and extends from the horizontal supporting portion 21. A roller 60 is located in, and partly extends out of, a trough in the surface of the tortuous portion 22. A mounting block 23 protrudes from the lower side of the horizontal supporting portion 21 and is located adjacent to the tortuous portion 22. An opening 24 is defined in the horizontal supporting portion 21 and in close proximity to the tortuous portion 22. The blocking member 50 is pivotably attached to the mounting block 23. The blocking member 50 includes a blocking portion 51 and a mounting portion 52 connecting to the blocking portion 51. The blocking portion 51 extends through the opening 24 and protrudes up from the horizontal supporting portion 21. The mounting portion 52 is pivotably attached to the mounting block 23 located at the lower side of the horizontal supporting portion 21. The blocking portion 51 is substantially perpendicular to the horizontal supporting portion 21 when the blocking member 50 is in a blocking position.

Figure 3:
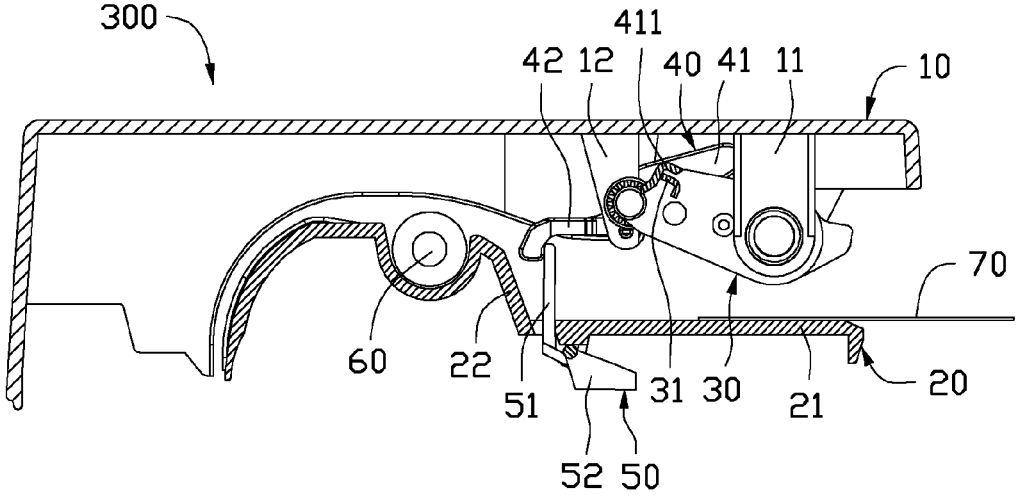
FIG. 3 is similar to FIG. 2, but showing the delivering module starting to deliver a paper for printing.

Referring to FIG. 3, when the delivering module 300 starts to operate, the first pivotable member 30 rotates from the original slanted position to a second slanted position in a clockwise direction. The second end of the first pivotable member 30 moves up from the horizontal supporting portion 21, thereby allowing a paper for printing (paper 70) full access to the paper tray 20. The first resisting piece 31 comes to rest against the second resisting piece 411. The first resisting piece 31 pushes the second pivotable member 40 to rotate in a counterclockwise direction, so the arm 421 is rotated down until the hook 423 abuts the top end of the blocking member 50, which prevents the blocking portion 51 rotating back and down (that is, in a counterclockwise direction).

Figure 4:
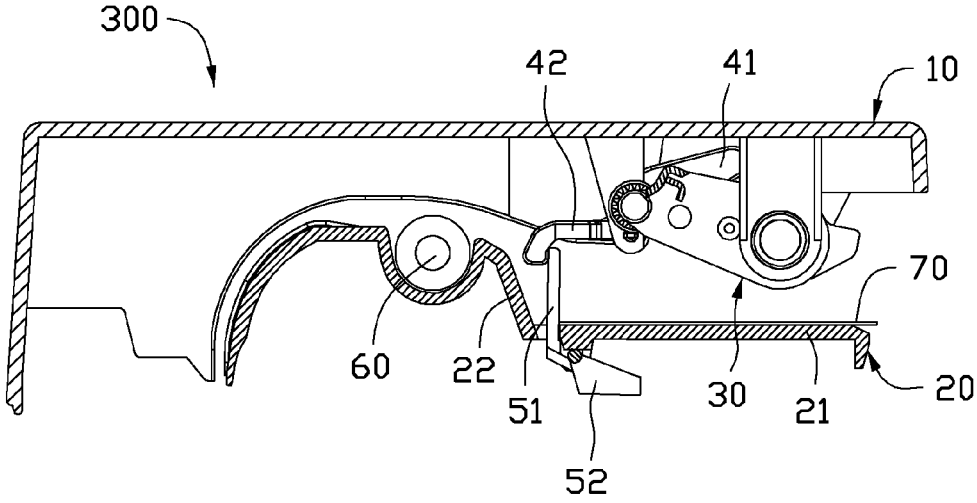
FIG. 4 is similar to FIG. 3, but showing the paper being blocked by a blocking member of the paper delivering module of FIG. 3.

Referring to FIG. 4, the paper 70 is slid into the paper tray 20 in a first horizontal direction until abutting the blocking portion 51. The detecting module 200 detects whether the paper 70 is correctly placed. In one embodiment, the detecting module 200 includes sensors or detectors attached in the delivering module 300 for detecting a position of the paper 70. If the paper 70 is incorrectly placed, the blocking member 50 remains locked by the hook 423. The blocking portion 51 prevents the paper 70 from sliding further in the first horizontal direction, and the paper 70 can not be delivered by the delivering module 300.

Figure 5:
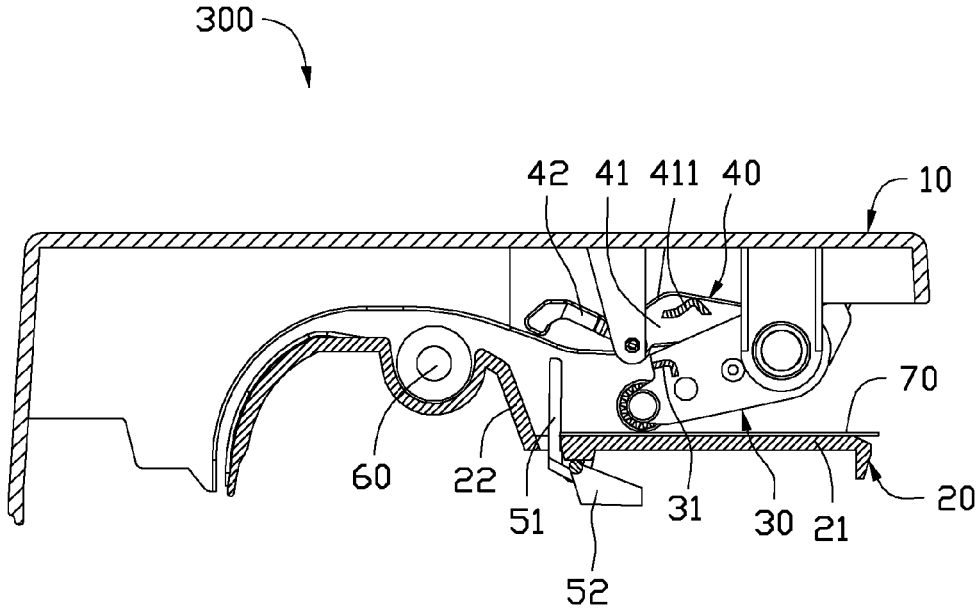
FIG. 5 is similar to FIG. 4, but showing the blocking member being released by a second pivotable member of the delivering module of FIG. 3.

Referring to FIG. 5, if the printing paper 70 is correctly placed, the first pivotable member 30 rotates down to its original slanted position in a counterclockwise direction. The second pivotable member 40 is thus released and rotates back to its original position, where the hook 423 is distanced from the blocking portion 51. Then the blocking member 50 is released by the second pivotable member 40 and can rotate freely.

Figure 6:
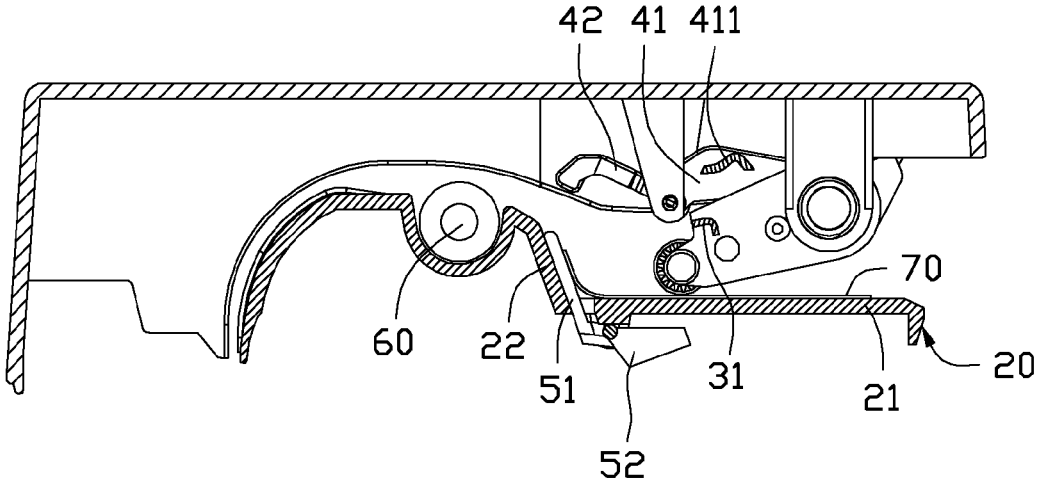
FIG. 6 is similar to FIG. 5, but showing the blocking member being rotated to a slanted position by the paper.

Referring to FIG. 6, the blocking portion 51 may rotate and fall back from the vertical blocking position, to a slanted position against the tortuous portion 22, thereby allowing the paper 70 to progress onto the tortuous portion 22. The paper 70 may slide from the horizontal supporting portion 21 onto the tortuous portion 22 over the blocking portion 51.

Figure 7:
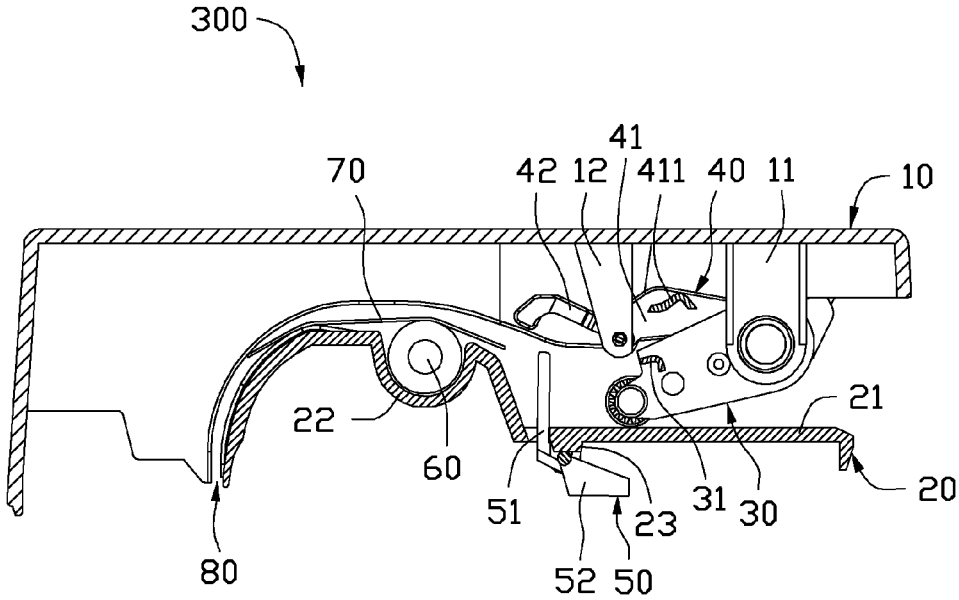
FIG. 7 is similar to FIG. 6, but showing the paper sliding across the blocking member.

Referring to FIG. 7, the paper 70 moving away from the horizontal supporting portion 21 and located above the tortuous portion 22 is urged towards the paper outlet 80 by the roller 60.

In one embodiment, one or more rollers can be placed on the horizontal supporting portion 21 to further urge the forward movement of the paper 70.

While the present disclosure has been illustrated by the description in this embodiment, and while the embodiment has been described in considerable detail, it is not intended to restrict or in any way limit the scope of the appended claims to such details. Additional advantages and modifications within the spirit and scope of the present disclosure will readily appear to those skilled in the art. Therefore, the present disclosure is not to be limited to the specific details and illustrative examples shown and described.

What is claimed is:

1. A paper delivering device comprising:

a paper tray for supporting at least one paper;

a cover above the paper tray;

a roller for delivering the at least one paper;

a detecting module for detecting whether the at least one paper is placed on the paper tray at a predetermined position;

a first pivotable member and a second pivotable member pivotably attached to the cover;

a blocking member, pivotably attached to the paper tray, and locked at a first position by the first and the second pivotable members where the blocking member separates the at least one paper from the roller to prevent sliding movement of the at least one paper when the at least one paper is not placed at the predetermined position, or rotated to a second position where the blocking member guides the at least one paper to the roller to allow sliding movement of the at least one paper when the at least one paper is placed at the predetermined position.

2. The paper delivering device of claim 1, wherein each of a first mounting piece and a second mounting piece extends from an inner surface of the cover.

3. The paper delivering device of claim 2, wherein the first pivotable member is pivotably attached to the first mounting piece; the second pivotable member is pivotably attached to the second mounting piece, the first pivotable member is rotatable between a first slanting position where the first pivotable member abuts the paper tray and a second slanting position where the first pivotable member is spaced away from the paper tray and abuts the second pivotable member.

4. The paper delivering device of claim 3, wherein a first L-shaped resisting piece extends from the first pivotable member, a second L-shape resisting piece extends from the second pivotable member, and the first L-shaped resisting piece abuts the second L-shaped resisting piece when the first pivotable member is in the first slanting position.

5. The paper delivering device of claim 4, wherein the second pivotable member is rotatable between an original position where the second pivotable member is spaced away from the blocking member, and a locking position where the second pivotable member abuts the blocking member to lock the blocking member at the first position.

6. The paper delivering device of claim 5, wherein a first end of the first pivotable member is pivotably attached to the first mounting piece, and a second end of the first pivotable member abuts the paper tray at the first slanting position; and the second pivotable member comprises a first portion and a second portion connected to the first portion, a junction between the first portion and the second portion is pivotably attached to the second mounting piece.

7. The paper delivering device of claim 6, wherein the first L-shaped resisting piece is located adjacent to the second end, and the second L-shaped resisting piece extends from the first portion.

8. The paper delivering device of claim 1, wherein a mounting block protrudes from a lower side of the paper tray, and an opening is defined in the paper tray and adjacent to the mounting tray; and the blocking member comprises a mounting portion pivotably attached to the mounting block and a blocking portion extending from the lower side to an upper side of the paper tray via the opening.

9. The paper delivering device of claim 8, wherein the paper tray comprises a flat supporting portion and a tortuous portion connected to the flat supporting portion, the mounting block protrudes from the flat supporting portion, and the opening is defined in flat supporting portion and in proximity to the tortuous portion.

10. The paper delivering device of claim 9, wherein the blocking portion is substantially perpendicular to the flat supporting portion at the first position, and the blocking portion is oriented obliquely relative to the flat supporting portion at the second position.

11. A paper delivering device comprises:

a delivering module comprising a paper tray for supporting at least one paper, a cover above the paper tray, a roller attached on the paper tray for delivering the at least one paper, a first pivotable member and a second pivotable member pivotably attached to the cover, and a blocking member pivotably attached to the paper tray; and a detecting module for detecting whether the at least one paper is placed at a predetermined position;

wherein the blocking member is locked at a first position by the first and the second pivotable members to prevent sliding movement of the at least one paper when the at least one paper is not placed at the predetermined position, or rotated to a second position to allow sliding movement of the at least one paper when the at least one paper is placed at the predetermined position.

12. The paper delivering device of claim 11, wherein the delivering module further comprises a first mounting piece and a second mounting piece extends from an inner surface of the cover.

13. The paper delivering device of claim 12, wherein the first pivotable member is pivotably attached to the first mounting piece; the second pivotable member is pivotably attached to the second mounting piece, the first pivotable member is roatable between a first slanting position where the first pivotable member abuts the paper tray and a second slanting position where the first pivotable member is spaced away from the paper tray and abuts the second pivotable member.

14. The paper delivering device of claim 13, wherein a first L-shaped resisting piece extends from the first pivotable member, a second L-shape resisting piece extends from the second pivotable member, and the first L-shaped resisting piece abuts the second L-shaped resisting piece when the first pivotable member is in the first slanting position.

15. The paper delivering device of claim 14, wherein the second pivotable member is rotatable between an original position where the second pivotable member is spaced away from the blocking member, and a locking position where the second pivotable member abuts the blocking member to lock the blocking member at the first position.

16. The paper delivering device of claim 15, wherein a first end of the first pivotable member is pivotably attached to the first mounting piece, and a second end of the first pivotable member abuts the paper tray at the first slanting position; and the second pivotable member comprises a first portion and a second portion connected to the first portion, a junction between the first portion and the second portion is pivotably attached to the second mounting piece.

17. The paper delivering device of claim 16, wherein the first L-shaped resisting piece is located adjacent to the second end, and the second L-shaped resisting piece extends from the first portion.

18. The paper delivering device of claim 11, wherein a mounting block protrudes from a lower side of the paper tray, and an opening is defined in the paper tray and adjacent to the mounting tray; and the blocking member comprises a mounting portion pivotably attached to the mounting block and a blocking portion extending from the lower side to an upper side of the paper tray via the opening.

19. The paper delivering device of claim 18, wherein the paper tray comprises a flat supporting portion and a tortuous portion connected to the flat supporting portion, the mounting block protrudes from the flat supporting portion, and the opening is defined in flat supporting portion and in proximity to the tortuous portion.

20. The paper delivering device of claim 19, wherein the blocking portion is substantially perpendicular to the flat supporting portion at the first position, and the blocking portion is oriented obliquely relative to the flat supporting portion at the second position.

* * * * *